United States Patent [19]

Holcombe et al.

[11] Patent Number: 4,810,846

[45] Date of Patent: Mar. 7, 1989

[54] CONTAINER FOR HEAT TREATING MATERIALS IN MICROWAVE OVENS

[75] Inventors: Cressie E. Holcombe, Farragut; Norman L. Dykes, Oak Ridge; Harold D. Kimrey, Jr.; James E. Mills, both of Knoxville, all of Tenn.

[73] Assignee: The United States of America as represented by the United States Department of Energy, Washington, D.C.

[21] Appl. No.: 148,530

[22] Filed: Jan. 26, 1988

[51] Int. Cl.[4] ..... H05B 6/80

[52] U.S. Cl. ..... 219/10.55 R; 219/10.55 D

[58] Field of Search ..... 219/10.55 K, 10.55 E, 219/10.55 D, 10.55 F, 10.55 A; 264/25, 26, 27

[56] References Cited

U.S. PATENT DOCUMENTS

| | | | |
|---|---|---|---|
| 3,585,258 | 6/1971 | Levinson | 219/10.55 E |
| 4,140,887 | 2/1979 | Sutton et al. | 219/10.55 E X |
| 4,221,680 | 9/1980 | Hardwick et al. | 219/10.55 R X |
| 4,307,277 | 12/1981 | Maeda et al. | 219/10.55 R |
| 4,416,907 | 11/1983 | Watkins | 219/10.55 E X |
| 4,499,356 | 2/1985 | Hatagawa | 219/10.55 E |

*Primary Examiner*—Philip H. Leung

*Attorney, Agent, or Firm*—Stephen D. Hamel; Judson R. Hightower

[57] ABSTRACT

The efficiency of a microwave oven of a conventional two-source configuration and energy level is increased by providing the oven with a container for housing a refractory material to be treated. The container is formed of top and bottom walls transparent to microwaves while the sidewalls, in a circular configuration, are formed of a nonmetallic material opaque to microwave radiation reflecting the radiation penetrating the top and bottom walls radially inwardly into the center of the container wherein a casket of heat-insulating material is provided for housing the material to be heat treated. The reflection of the microwave radiation from the sidewalls increases the concentration of the microwaves upon the material being heat treated while the casket retains the heat to permit the heating of the material to a substantially higher temperature than achieveable in the oven without the container.

8 Claims, 1 Drawing Sheet

CONTAINER FOR HEAT TREATING MATERIALS IN MICROWAVE OVENS

This invention was made as a result of a contract between Martin Marietta Energy Systems, Inc. and the U.S. Department of Energy.

BACKGROUND OF THE INVENTION

The present invention relates generally to the heat treating, sintering, or heating of refractory materials characterized by metal compounds such as oxides, nitrides, and sulphides by microwave energy and more particularly to the heating of such refractory materials in a microwave kiln or oven provided with a container which houses the material being heated and increases the efficiency of the microwave oven for concentrating microwave radiation on the housed material.

The utilization of microwave energy is receiving considerable interest for utilization in various refractory heating procedures since it is a relatively inexpensive source of heat and microwave radiation provides rapid and clean heating. The conventional microwave ovens or kilns utilized for heat treating various metal compounds such as oxides, nitrides, or sulphides have met with considerable success but yet suffer some shortcomings which detract from their overall effectiveness for heat treating or heating materials which are relatively poor susceptors or couplers of the microwave radiation so as to be slow in heating or even incapable of being heated to a temperature adequate for effecting the desired heating procedure on the material.

A significantly high loss of microwave radiation is normally encountered in the ovens presently available in that the heating of the material is effected by absorption of microwave energy by the material or a component of the material which functions as a susceptor for the microwave energy. Often the material does not contain sufficient microwave suscepting material to effect the heating thereof or is of a density which is less than that which will provide adequate coupling of the microwave energy as it passes through the article for obtaining the desired level of heating. This energy loss occurs when the microwaves miss the couplers or susceptors in the material as it passes therethrough. Energy losses also occur when the microwaves are passing through a region of the oven remote to the material. Efforts have been made to overcome these energy losses in conventional microwave ovens and include such practices as the employment of higher power levels and/or higher frequencies for heating the material to the desired high temperature. The provision of such higher power levels and/or frequencies is frequently unavailable for commercially provided microwave kilns or ovens and even if available are somewhat undesirable due to the poor economics of such ovens since the energy loss is even greater in these higher-powered ovens due to the increased number or energy level of the microwaves missing the coupling material in the solid compound being heated.

SUMMARY OF THE INVENTION

Accordingly, it is a primary aim or objective of the present invention to provide a container which may be placed within a conventional microwave kiln or oven of the type preferably having a source of electromagnetic or microwave radiation in the upper and lower walls of the oven and which encloses or houses the material to be heated in such a manner that the microwave energy is concentrated on the material being heated. Generally, the container of the present invention utilizes a construction in which the microwave radiation that would normally pass by the material being heat treated is reflected inwardly toward the material so as to concentrate the microwave radiation at the point within the oven where it is most useful for heating the material to the desired temperature. The microwave oven utilizing the container of the present invention may use any suitable microwave radiation source, such as magnetrons, centrally disposed at the top and bottom of the microwave oven, and waveguides for directing microwave energy into the oven. Of course, if desired. a single electromagnetic radiation source disposed in either the top or bottom wall of the oven may be utilized for heating the material.

The container for heating the material in the microwave oven comprises top wall means and bottom wall means, each formed of a nonmetallic material which is substantially transparent to microwave radiation. Vertical sidewall means are disposed between and contact the top wall means and the bottom wall means for defining therewith an enclosed chamber. The vertical wall means unlike the top and bottom wall means are formed of a material substantially opaque to and non-coupling with the microwave radiation for reflecting the microwave radiation into the chamber after passing through either the top wall means or the bottom wall means. Casket means are disposed in the enclosed chamber and have an enclosable cavity therein for receiving a material to be heated by microwave radiation. The casket means are formed of a material substantially non-coupling with the microwave radiation. A conduit means may be disposed through one of the wall means of the container for conveying an inert gas into the enclosed chamber for providing flooding the chamber with an inner gas atmosphere during the heating of the material within the casket.

The vertical wall means of the container are in the form of an open cylinder so that the curved side walls reflect the radiation radially inwardly towards the radial center of the chamber where the casket is disposed so as to concentrate the microwave energy upon the material being heated within the casket. This redirected concentration of microwave energy effectively provides for a level of radiation on the material that would normally be obtained only by using a substantially more powerful radiation source. This relatively simple approach to microwave radiation heating effectively obviates the requirement for such relatively expensive high-frequency microwave emitters or ovens with such emitters.

Other and further objects of the invention will be obvious upon an understanding of the illustrative embodiment and method about to be described or will be indicated in the appended claims and various advantages not referred herein will occur to one skilled in the art upon employment of the invention in practice.

Figure 1:
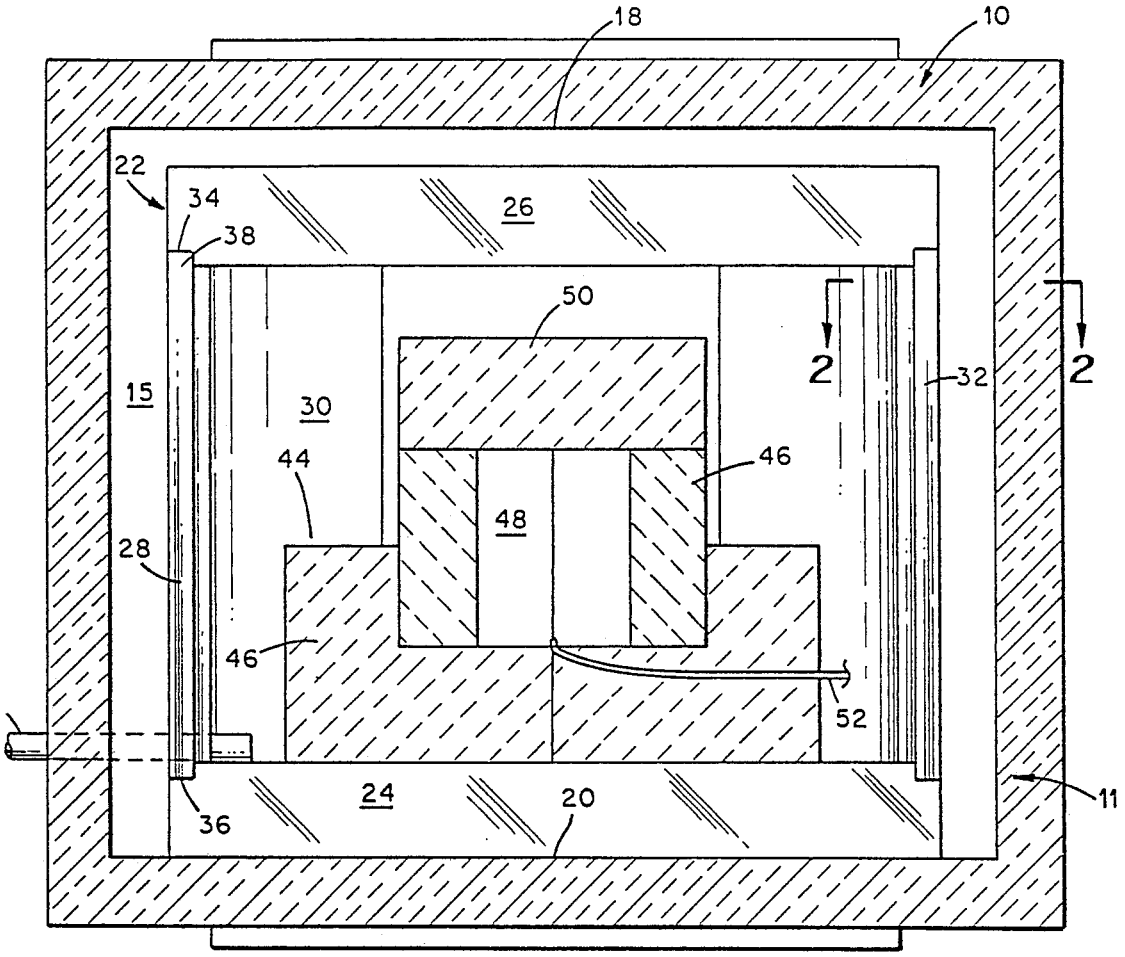
FIG. 1 is a vertical sectional view of a microwave oven with the container of the present invention.
Figure 2:
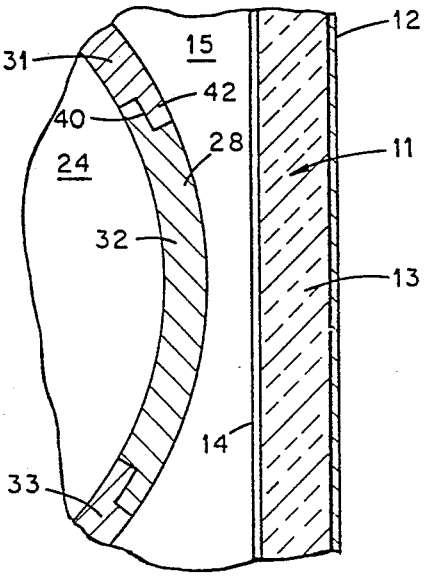
FIG. 2 is a fragmentary sectional view taken along lines 2—2 of FIG. 1 showing details of the container of the present invention.

The embodiment of the invention chosen for the purpose of illustration and description is not intended to be exhaustive or to limit the invention to the precise form disclosed. It is chosen and described in order to best explain the principles of the invention and their application in practical use and thereby enable others skilled in the art to best utilize the invention in various embodiments and modifications as are best adapted to the particular use contemplated.

DETAILED DESCRIPTION OF THE INVENTION

With reference to the drawings there is shown a microwave oven 10 comprising a housing 11 of a conventional rectangular shape and formed of an outer wall 12 of metal, a layer of heat insulating material 13 and an inner wall or panel 14 of a microwave reflecting material such as aluminum or welded steel sheet metal. The microwave oven is provided with a generally rectangular or square cavity or volume 15 within the walls. A door, not shown, is usually attached to housing 11 for providing access to the volume 15. In conventional microwave ovens the materials to be heated are placed in the oven and subjected to a microwave radiation which is normally provided by suitable microwave sources located at vertically opposite sides of the cavity. For example, a microwave source such as a magnetron may be disposed in the top wall or roof 18 of the housing 11 while a similar magnetron may be disposed in the floor or base 20 of the housing 11. The microwave radiation sources are arranged to conduct microwave energy primarily into the central portion of the housing volume 15 by employing well known waveguides and/or antennas, not shown.

The container of the present invention is generally shown at 22 and is positioned within the volume 15 of the microwave oven. The container 22 is preferably constructed to be of a size which will permit its placement within the volume 15 of the housing 11 so as to essentially fill the space between the top wall 18 and the floor 20 defining the vertical expanse of the volume 15 as generally shown in FIG. 1. The container 22 comprises a bottom wall or base 24 of a material such as fused silica which is essentially transparent to or non-coupling with microwave energy. If desired the bottom wall 24 may be formed of other materials such as alumina, yttria, boron nitride, magnesia, steatite, mullite, or silicon nitride which are relatively non-susceptive or coupling with microwave radiation. The bottom wall is shown as being in a discoidal configuration for forming the preferred configuration of the container.

Oppositely disposed from the bottom wall 24 is the top wall 26 of the container 22 which will be positioned near the roof 18 of the housing 11. The top wall, 26 is of a size and configuration similar to the bottom wall 24 and is formed of a material transparent to or non-coupling with the microwave energy. This wall 26 is formed of the same material as the bottom wall 24.

The container 22 is provided with vertically extending sidewalls 28 which are positioned between and in contact with the top and bottom walls 24 and 26 to define therewith a chamber 30. The sidewalls 28 are formed of a material essentially opaque to microwave radiation so as to reflect the microwaves contacting the wall after passing through the top wall 26 or the bottom wall 24 back into the chamber so as to retain the microwave radiation within the chamber 30. These side walls are formed of a non-metal material preferably graphite or a graphitic composite material which provides suitable reflection of the microwave radiation. The sidewalls 28 may be formed of several accurate wall segments such as generally shown at 31, 32, and 33. These wall segments 31 through 33 when joined together with similar arcuate wall segments form a circular or open cylinder configuration so as to provide for the reflection of the microwave radiation from the sidewalls radially inwardly towards the center of the chamber 30. The walls 24, 26 and 28 are preferably provided with a suitable construction which when in contact with each other provide for a relatively snug or tight fitting construction. For example, the top and bottom walls 26 and 24 may be provided with peripheral recesses 34 and 36 respectively which receive shoulders 38 on the wall segments 32 for providing a tongue-and-groove type construction for joining the sidewalls 28 to the top and bottom walls. Similarly the sidewall segments may be provided with vertically extending tongue and grooves 40 and 42 to provide a structurally sound sidewall arrangement. The ingress into or egress from the chamber 30 may be provided through the sidewall by removing one of the wall segments while the container is in place within the oven. Alternatively, if desired, the container may be inserted into the microwave housing after the material to be treated is placed within the container chamber 30. In such instances, the top wall 26 may be readily removed from the container and the material to be heat treated placed within the chamber 30.

In order to heat treat the material within the container of the present invention, the material is placed within a case or casket 44 which is placed on the base 24 in the chamber 30 so that energy reflected from the sidewalls 26 will converge towards the center of the chamber and concentrate on the material within the case or casket. This casket 44 may be readily formed of alumina, silica, or alumina-silica insulating bricks which are relatively non-coupling with microwave energy and yet are sufficiently insensitive to heat so that high temperature metallurgical procedures may be conducted within the casket. The bricks, as generally shown at 46, may be hollowed out to provide a centrally located cavity 48 where the metallurgical process may be achieved. A cap or lid 50 formed of the brick material is used to enclose the cavity.

A thermocouple 52 may be placed within the cavity for monitoring the metallurgical procedure. Also, if desired, the metallurgical procedure may be conducted in an inert atmosphere by extending a conduit 54 through a suitable wall of the container so as to flood the interior or the chamber 30 with an inert gas such as argon or helium during metallurgical procedures.

In a demonstration of the subject development, a disc of zirconia was heat treated in a two-source microwave oven with and without the container of the present invention. In employing the container of the present invention the disc of zirconia was placed within the cavity 48 of the casket 44 and the lid 50 placed upon the casket. The casket 44 was placed in the chamber 30 of the container by removing and replacing a side wall segment. The container was then placed within the microwave oven. The microwave radiation sources were operated so as to expose the disc of zirconia to microwave energy at a frequency of 2.45 GHz for a 30-minute duration in an argon atmosphere. The thermocouple positioned within the casket indicated that the zirconia was heated to a temperature of 1900° C. while in the container of the present invention.

Conversely, a similar disc of zirconia exposed to the same level of microwave radiation in the same microwave oven without the container of similar heating duration. This temperature is significantly lower than that achieveable by using the container of the present invention.

The utilization of the circular graphite walls for forming the container provides for the reflection of microwave radiation into the center of the chamber. Thus, with the casket essentially centrally located within the chamber the concentration of the microwave radiation is relatively high within the casket volume as compared to areas of the oven outside of the container. Further, since the case or casket 44 is formed of good heat insulating materials such as alumina, a high level of heat retention is achieved in the material being treated to prevent or minimize heat loss as would normally occur in a conventional microwave oven. Satisfactory heat circulation may be achieved by using alumina bricks of a density in the range of about 10 to 50 percent of theoretical density. The use of the heat insulating material in the fabrication of the casket allows the material being heat treated therein to achieve a higher temperature with a relatively low amount of microwave radiation. Thus, by employing the container of the present invention, the efficiency of conventional microwave ovens can be extensively increased so that additional applications of microwave ovens become readily feasible.

We claim:

1. A container for heating refractory material in a microwave oven to receive microwave radiation from microwave radiation emitting means disposed on at least one of vertically separated sides of a volume in said oven, said container positionable within and essentially filling the vertical expanse of said volume and comprising top wall means and bottom wall means each formed of a material substantially transparent to and non-coupling with microwave radiation, vertical wall means disposed between and contacting said top wall means and said bottom wall means for defining therewith an enclosed chamber, said vertical wall means being formed of graphite or a graphite composite characterized by being substantially opaque to and non-coupling with microwave radiation for reflecting microwave radiation inwardly into said chamber after passing through at least one of said top wall means and said bottom wall means, and casket means disposed in said enclosed chamber and having an enclosable cavity therein for receiving a material to be heated by microwave radiation, said casket means being formed of a heat insulating material substantially non-coupled with and transparent to microwave radiation.

2. The container claimed in claim 1, wherein the casket is centrally located within said enclosed chamber with said cavity being essentially uniformly spaced from the vertical wall means.

3. The container claimed in claim 1 wherein the material of the top wall means and the bottom wall means is selected from silica, alumina, yttria, boron nitride, or silicon nitride.

4. The container claimed in claim 4 wherein the casket is formed of alumina of a density in a range of about 10 to 50 percent of theoretical density.

5. The container claimed in claim 1 wherein a conduit means penetrate said enclosed chamber for conducting an inert gas into said chamber for providing an inert atmosphere within said chamber during the heating of said material in said cavity.

6. The container claimed in claim 1, wherein the vertical wall means are vertically oriented in a circular configuration to define a cylindrically-shaped enclosed chamber.

7. The combination of a microwave oven and a container for heating refractory material in the microwave oven, said microwave oven having a housing with a volume therein for receiving said container and microwave radiation emitting means disposed on vertically separate sides of said volume, said container comprising top wall means and bottom wall means each forward of a material substantially transparent to and non-coupling with microwave radiation and positionable with said volume with said top wall means and said bottom means each disposed adjacent to one of said radiation emitting means, vertical wall means disposed between and contacting said top wall means and said bottom wall means for defining therewith an enclosed chamber, said vertical wall means being formed of graphite or a graphite composite characterized by being substantially opaque to and non-coupling with microwave radiation for reflecting microwave radiation inwardly into said chamber after passing through at least one of said top wall means and said bottom wall means, and casket means disposed in said enclosed chamber and having an enclosable cavity therein for receiving a material to be heated by microwave radiation, said casket means being formed of a heat insulating material substantially non-coupling with and transparent to microwave radiation.

8. The combination claimed in claim 7, wherein the vertical wall means are vertically oriented in a circular configuration to define a cylindrically-shaped enclosed chamber.

* * * * *